US005097966A

United States Patent [19]

Miller

[11] Patent Number: 5,097,966

[45] Date of Patent: Mar. 24, 1992

[54] STORAGE RACK

[75] Inventor: George A. Miller, Boulder, Colo.

[73] Assignee: Wood Logic, Inc., Boulder, Colo.

[21] Appl. No.: 581,586

[22] Filed: Sep. 12, 1990

[51] Int. Cl.[5] ..... A47F 5/00

[52] U.S. Cl. ..... 211/87; 211/70.6; 211/65

[58] Field of Search ..... 211/70.6, 65, 66, 87, 211/60.1, 59.1, 69.1, 32, 35, 71

[56] References Cited

U.S. PATENT DOCUMENTS

| | | | |
|---|---|---|---|
| 862,841 | 8/1907 | Newport | 211/94 X |
| 1,095,068 | 4/1914 | Bate | 211/65 X |
| 1,687,129 | 10/1928 | Henninger | 211/87 X |
| 2,295,886 | 9/1942 | Beck | 211/35 |
| 2,423,292 | 7/1947 | Brown | 211/65 |
| 2,661,098 | 12/1953 | Wannop | 211/87 |
| 3,938,667 | 2/1976 | Buckland | 211/87 |
| 4,162,015 | 7/1979 | Hodges | 211/87 |
| 4,852,930 | 8/1989 | Agee | 211/70.6 X |
| 4,877,140 | 10/1989 | Lee | 211/205 X |
| 4,878,586 | 11/1989 | Bancroft et al. | 211/59.1 X |

*Primary Examiner*—Robert W. Gibson, Jr.
*Attorney, Agent, or Firm*—Timothy J. Martin; Dana S. Rewoldt

[57] ABSTRACT

A storage rack for supporting an ensemble of implements alongside an upright support surface includes a base member and a plurality of removable supports rods. The base member has a plurality of equidistantly spaced, angled support rod bores in its front face, and each support rod has a first end portion sized for close-fitting, slideable mated engagement in each of the support rod bores. Fasteners may mount the base member to the support surface. Preferably, the support rod bores are at an acute angle to the front surface so that, when a support rod is inserted, the rod extends forwardly and upwardly to terminate in a free end. The rod and bore sizes may be selected so that the free end of each support rod is in a common plane with the top surface of the base member. Tremendous versatility in the configuration of an array of active support rods is therefore provided, and, in the alternate exemplary embodiments, storage bores and a storage groove are respectively disclosed for holding extra storage.

18 Claims, 3 Drawing Sheets

STORAGE RACK

FIELD OF THE INVENTION

The present invention relates generally to storage racks for various implements whereby the implements may be mounted for storage alongside a support surface. Specifically, the present invention relates to wall mounted storage rack assemblies of the type which may mount tools and implements such as shovels, rakes, hoes, brooms and the other home and garden tools and implements and equipment, such as skis and ski poles. The field of the present invention concerns storage rack systems which may be organized by selected support 10 configurations so as to be customized for different implement ensembles.

BACKGROUND OF THE INVENTION

The storage of possessions has long been a problem facing any owner of those possessions. Where there is competition for storage locations as a function of the number of items to be stored and the space in which a storage is avialable, the provision of suitable storage systems become evermore necessary. Not only is the organization of storage of one's possessions necessary in order that one's living space remain neat and tidy, but also organization avoids disarray which can cause lost time in hunting a particular item when use of the item is desired.

Often, many tools and implements are stored in either a storeroom, garage or storage shed. These areas tend to degenerate into a state of substantial disarray since they typically comprise dwelling areas which may be closed off from the dominant living quarters of the dwelling. As a result, it is not unusual for persons who reside in the dwelling to keep items in such storage areas relatively in a haphazard manner. This tendency derives not only from a lack of diligence but also from the lack of inexpensive and versatile storage rack assemblies commercially available which assemblies are easy to install and thereafter convenient to use.

A variety of storage systems have been developed in the past ranging from closets and cabinet structures to shelving systems, bin assemblies and pegboard systems. While the utility of these prior art systems cannot be disputed. Nonethless, these system have not been completly effective in providing the right kind of storage system; otherwise, the problem of disorganized storage areas would not be as pervasive a problem as it is. Therefore, there remains a long felt need for improved storage systems. The present invention provides a storage rack apparatus directed to solving, at least in part, the storage problem. This storage rack, while simple in appearance and use, is nonetheless subtle in the advantage it provides over the prior art structures.

SUMMARY OF THE INVENTION

It is an object of the present invention to provide a new and useful storage rack that is simple to install and easy to use.

Another object of the present invention is to provide a storage rack that is relatively inexpensive in maufacture yet which provides surprising versatility in use.

Yet another object of the present invention is to provide a storage rack which may be custom configured by the user to accommodate a host of different implements in a stored state.

It is still a further object of the present invention to provide a storage rack that may be mounted on an upright support surface, such as on a vertical wall, and which supplies support for a variety of implements and equipment in an efficient manner utilizing limited space on the upright support surface.

According to the present invention, then, a storage rack is provided and is adapted to be mounted on an upright surface so that it is operative to support implement in a stored state. In its broad form, the strorage rack includes an elongated base mamber having selected length, a front surface and back surface. The base member is provided with the plurality of support rod bores formed therein with each support rod bore extending from a respective bore opening in the front surface of the base member at least partially through the base member. Mounts are provided for mounting the base member to the support surface. A plurality of elongated support rods are provided with each support rod including a first end potion sized and dimension for close fitting yet slideable mated engagement with each of said support rod bores so that when engaged, the respective support rod is in an active state. Each support rod includes a second end portion which extends forwardly of the front surface when in the active state so as to terminate in a free second end. Since each first end portion can be received in each of the support rod bores, a selected number of the support rods may be inserted into selected ones of the support rod bores and thus organized into a selected yet variable array so as to receive and support the implements from the base member alongside the support surface.

Preferably, each of the support rod bores in the base member are equidistantly spaced from one another and have a bore axis oriented at an acute angle with respect to the front surface whereby, when the base member is mounted in the horizontal position on the support surface, each of the support rods that is in the active state extends forwardly and upwardly from the front surface. In the preferred form of the invention, the base member has a top surface, and each support rod bore has a depth selected to cooperate with the length of each support rod so that, when the support rod is in the active state, the free end of the respective support rod terminates generally in a common plane with the top surface. For ease of manufacture, each of the support rods is preferably cylindrical, and each of the support rod bores is circular in cross-section. To this end also, the first end portion of each support rod may terminate in a flat transverse face; each of the support rod bores than extends only partially through the base member to terminate in a flat transverse end wall so that, when the support rods are in the active state, each respective flat face is generally flush with the respective flat end wall.

In the preferred form of the invention, the base member is constructed of wood although other materials may be uesd. When mounted, the base member is mounted generally flush with the back surface of the base member is mounted generally flush with the support surface. In order to accomplish mounting, a plurality of mounting bores extend completely through the base member and threaded fasteners are provided which are sized to extend through the base member to fasten to the support surface. To enhance the pleasing appearance of the support rack, each mounting bore may have a mounting bore opening in the front surface that is countersunk to define a cavity, and each fastener may have a head portion received in the mounting bore cavity. A plurality of cap elements are provided for enclosing each of the mounting bore cavities so as to hide the head of the fastener.

In desired, the base member may be provided with an auxiliary holding structure for receiving and storing extra ones of the support rods that are not in the active state. In one alternate form, this structure is defined by a plurality of auxiliary storage bores formed in the base member and extending vertically through the top surface. Each of these auxiliary storage bores are sized to receive an extra one of the support rods when not in use. The auxiliary storage bores may each be placed in space relation between a pair of the support rod bores. Alternately, the holder structure may be defined by an elongated groove formed in the top surface.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention generally relates to storage rack structures, but particularly relates to storage rack structures for supporting implements, such as garden and lawn tools, household tools or other objects, such as skis and ski poles, which may be hung in a suspended and stored state alongside an upright support surface. In its broad form, this invention includes a base member that is mounted to the support surface by suitable fasteners and a plurality of implement support rods which may be variably orgqanized in a desired pattern or array so that the user may customize the storage rack as desired. Furthermore, the present invention is particularly adapted to be marketed in a kit form for the "do it yourselfer".

Figure 1:
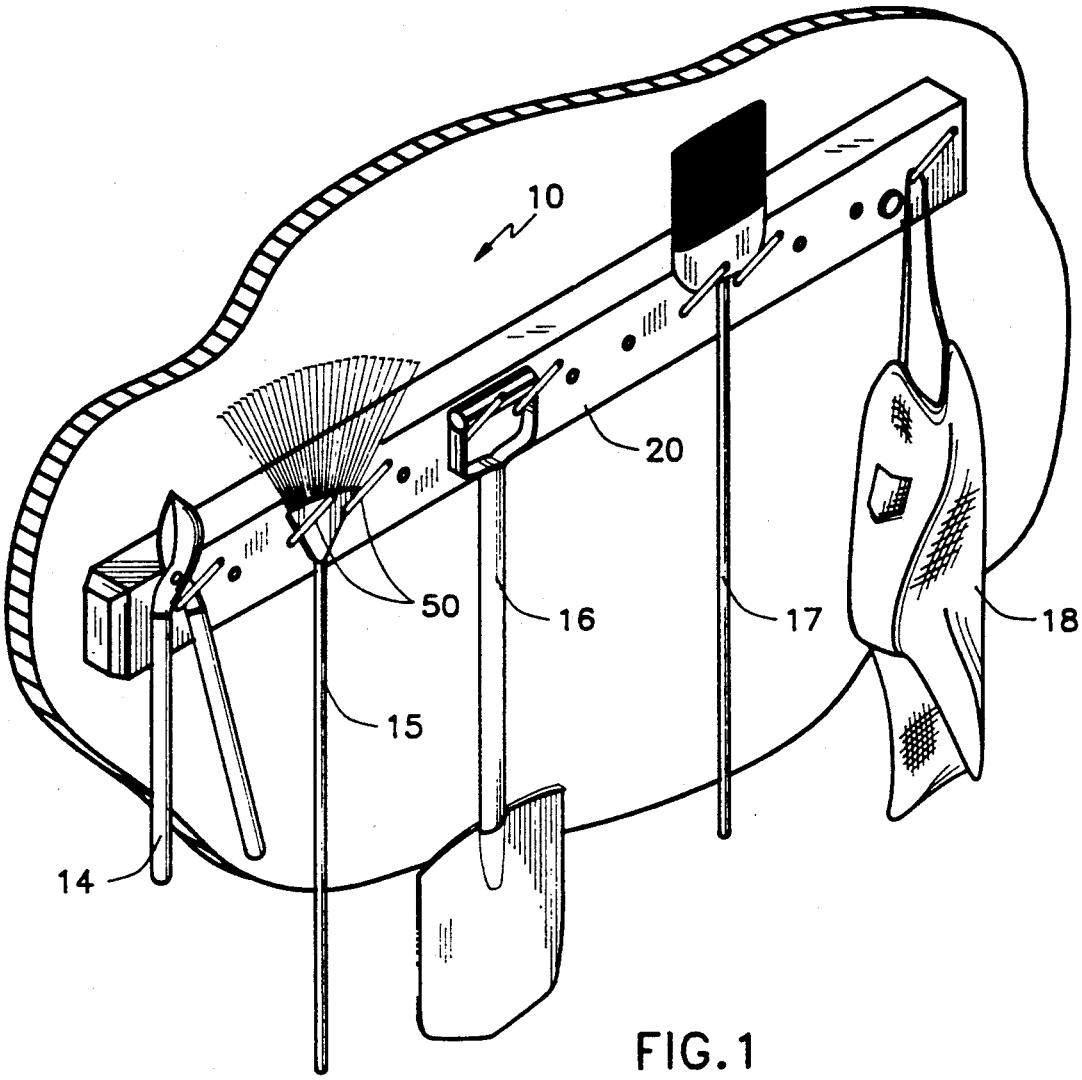
FIG. 1 is a perspective view of the storage rack according to the preferred embodiment of the present invention shown mounted on a support surface and supporting implements thereon.

The preferred form of the present invention is best shown, then in FIGS. 1–4. In FIG. 1, it may be seen that storage rack 10 is mounted to an upright support surface in the form of vertical wall 12 and is mounted horizontally thereon. Storage rack 10 includes a base member 20 that mounts a plurality of support rods, such as rods 50 which, in the active state shown in FIG. 1, are operative to support a plurality of implements alongside a vertical wall 12. Thus, for example, pruning shears 14, rake 15, shovel 16, broom 17 and apron 18 are hung on selected ones of support rods 50 for illustration purposes. It should be understood that the variety of implements to be supported by storage rack 10 is virtually unlimited and, to this end as more thoroughly described below, the storage rack 10 constructed according to the exemplary embodiment of the present invention may be customized so that the support rods are organized in a selected variable array.

Figure 2:
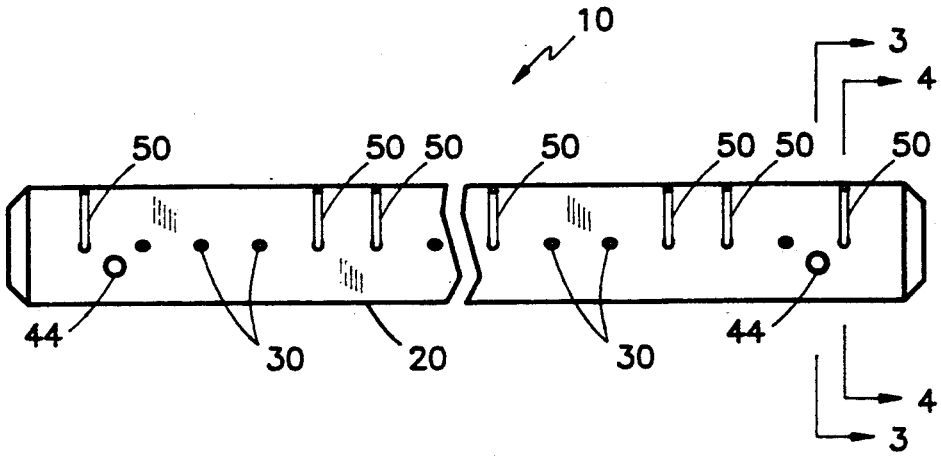
FIG. 2 is a front view in elevation of the storage rack of FIG. 1.
Figure 3:
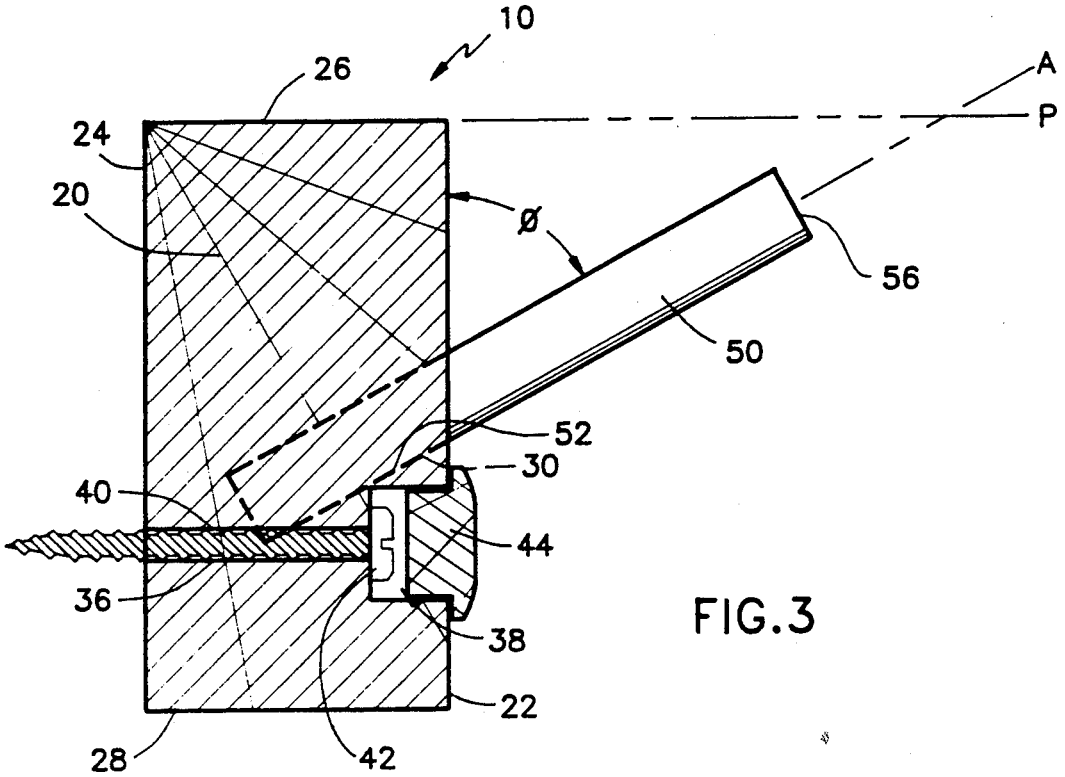
FIG. 3 is a cross sectional view taken about lines 3—3 of FIG. 2.
Figure 4:
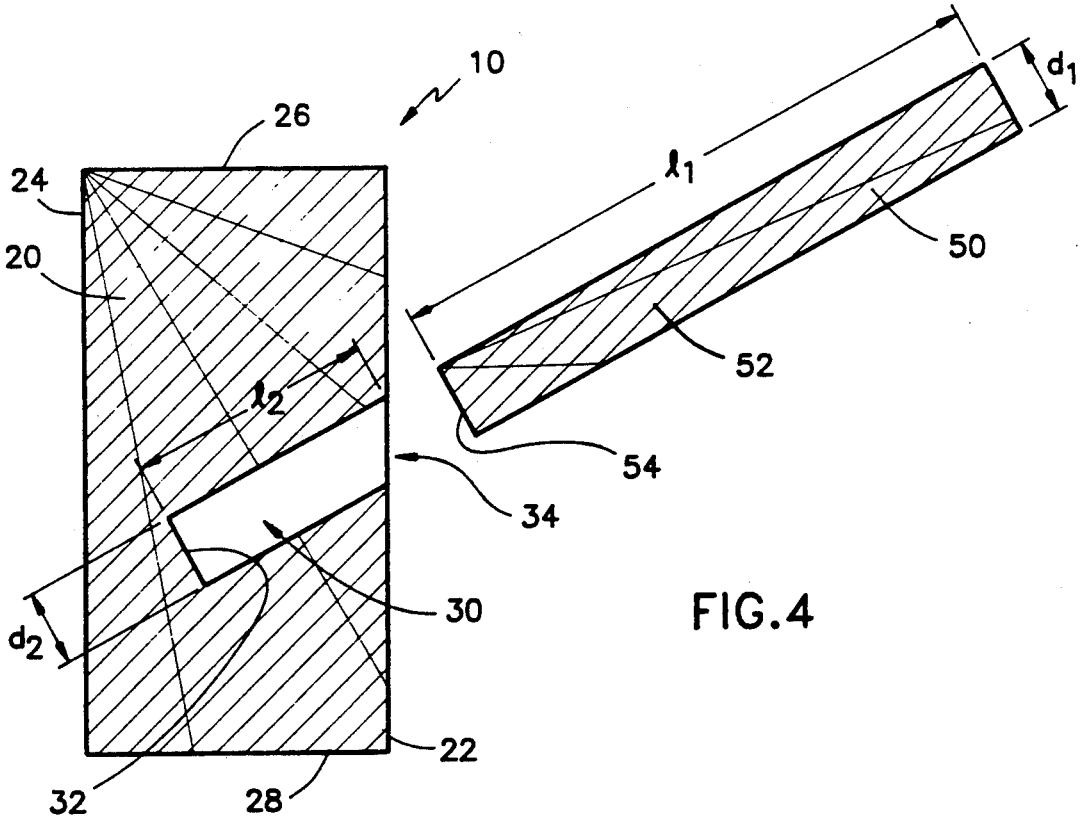
FIG. 4 is a cross-sectional view taken about lines 4—4 of FIG. 2.

With greater particularity, as is shown in FIGS. 2–4, base member 20 has a front surface 22, a back surface 24, a top surface 26, and a bottom surface 28. In the preferred form of the present invention, base member 20 is constructed of wood, as preferable an elongated piece of wood cut to approximately 1½ inches by 3½ inches and cross-sectional (commonly known as a 2×4). Alternately, base member 20 could be formed of a plastic material molded in any shape within the skill of the ordinarily skilled person in this field having read of the disclosure of this invention.

Turning again to FIGS. 2–4, it may be seen that base member 10 has a plurality of support rod bores 30 formed in front surface 22, and, as seen in FIG. 4, these bores 30 extend partially through the thickness of base member 20 to terminate in a flat end wall 32 opposite bore opening 34 in front surface 22. As is shown in FIG. 2, bore 30 is formed at an acute angle with respect to front surface 22 so that bore 30 and support rod 50 have a common access "A" which is oriented at an acute angle $\phi$ with respect to front surface 22. Bores 30, as shown in FIG. 2, are preferably equidistantly spaced along the length of base member 20 and are circular in cross-section.

Referring again to FIGS. 2–3, mounting means is provided for mounting base member 20 to support the upright support surface. To this end, a plurality of mounting bores 36 each extend completely through base member 20 from front surface 22 to back surface 24. Mounting bores 36 are counter sunk at front surface 22 to form cavities 38. Thus, an elongated fastener, such as threaded screw 40, may extend through bore 36 with head 42 of screw 40 resting in cavity 38. A plurality of end caps, such as end cap 44 are provided to enclose each cavity 38 and thus hide head 42 of fastener 40 in order to present a pleasing appearance when base member 20 is mounted on the upright support.

As noted above, a plurality of support rods 50 are provided, with each support rod 50 preferably being a cylindrical dowel which may be again formed of wood, plastic or suitable material. Each suppport rod 50 has a first end portion 52 which is a sized and dimensioned for close fitting mated engagement with any one of the bores 30 along the length of base member 20. End portion 52 terminates in a flat first end face 54 which is transverse to axis A so that, when inserted into the active state, shown in FIG. 3, end face 54 will rest in flat, flush abutment with flat end wall 32 of the respective bore 30. Support rod 50 has a diameter $d_1$ and bore 30 has a diameter $d_2$, as best shown if FIG. 4. Diameters $d_1$ and $d_2$ are selected so that $d_2$ is only slightly larger than $d_1$ so that first end portion 52 is snug in bore 30 yet slideable with respect thereto so as to be close fitting yet releasable mated engagement with bore 30. Further, as is shown in FIGS. 3 and 4, support rod 50 has a selected length "$l_1$" which cooperates with the depth "$l_2$" of bore 30 so that, when in the active state shown in FIG. 3, support rod 50 terminates at a free end 56 opposite of first end portion 52 with free end located generally in the common plane "P" with top surface 26 of base member 20, when rod 50 is at angle $\phi$ with respect to front surface 22 of base member 20. It should be understood from this configuration that even small torque forces caused by the force of gravity acting on implements supported by support rod 50 operate to frictionally lock in its respective bore 30 so that inadvertent withdrawal of each support rod 50 is difficult when implements are removed from storage rack 10 yet release of each rod 50 from its bore 30 in the axial direction is relatively easy.

The operation of storage rack 10 may now be more fully appreciated with reference to FIGS. 1-4. First, the user selects a desired horizontal located for base member 20 and mounts base member 20 to the upright support surface, such as vertical wall 12 by inserting fasteners 40 through each bore 36 and securing the fasteners 40 into the upright support surface. Cap elements 40 are then wedged into cavities 38 to hide head 42 of each fastener 40. The installer then determines what implements are to be stored on storage rack 10 and accordingly selects a desired array for a plurality of support rods 50 in selected ones of support rod bores 30. In some instances, a single support rod 50 may be used to support an item, such as pruning shears 14 or arpon 18 while, in other instances, two or more support rods 50 may be employed such as the rod pairs used to support rake 15, shovel 16 and broom 17. In any event, a significant benefit of the present invention is the tremendous flexibility avilable for customizing an array of support rods 50 so as to support different implements and to space apart those implements form one another by inserting a desired number of support rods 50 in desired ones of the bores 30 in the selected array, this structure allows a'most unlimited variability in the permutations of support rod arrays, such limitation being mathematically determined by the number of support rod bores and support rods therefor.

Since, in standard practice, there will be fewer support rods 50 employed in an active state on base member 20 in some instances and since the ability to reconfigure the support rod array as desired, it is helpful to provide means for holding extra ones of the support rods when not in use. To this end, two alternate embodiments of such holding means is provided. A first alternate embodiment is shown in FIGS. 5 and 6, and a second alternate embodiment is shown in FIGS. 7 and 8.

Figure 5:
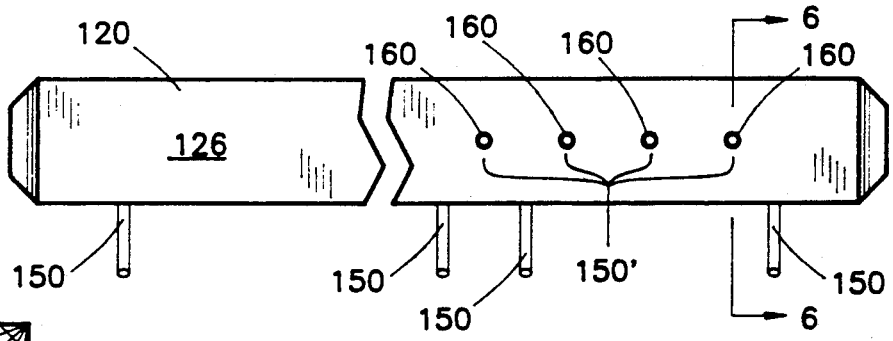
FIG. 5 is a top plan view of an alternate embodiment of the present invention showing auxiliary holding structure for extra ones of the support rods.
Figure 6:
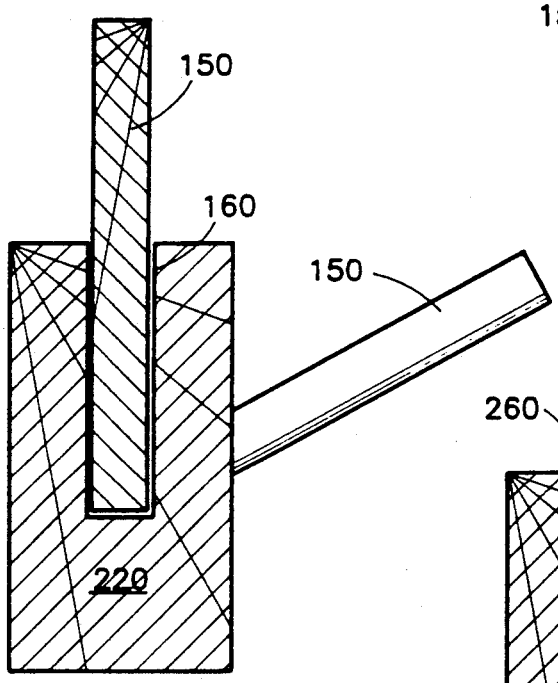
FIG. 6 is a cross-sectional view taken about lines 6—6 of FIG. 5.

Turning to FIGS. 5 and 6, it may be seen that alternate storage rack 110 includes a base member 120 provided with a plurality of support rods 150 in an active state. Base member 120 has a top surface 126 that is provided with a plurality of vertical auxiliary storage bores 160 which may receive extra storage rods 150' when not in use. The diameter of each of the auxiliary bores 160 may be larger than diameter $-d_2$" of each bore 30 so that extra rods 150' fit rather loosely in the selected bores 160 for ease of insertion and removal.

Figure 8:
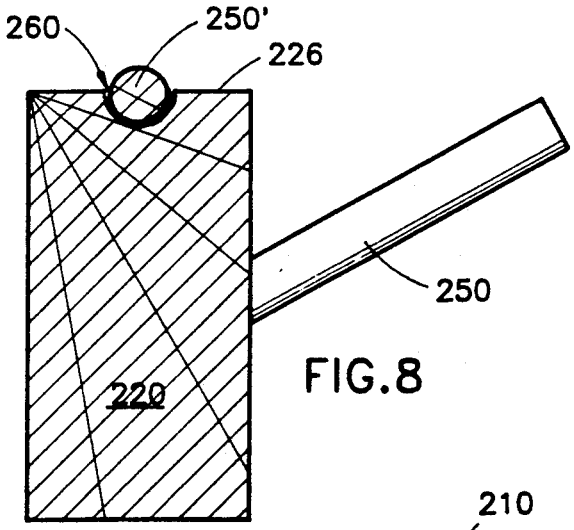
FIG. 8 is a cross-sectional view taken about lines 8—8 of FIG. 7.
Figure 7:
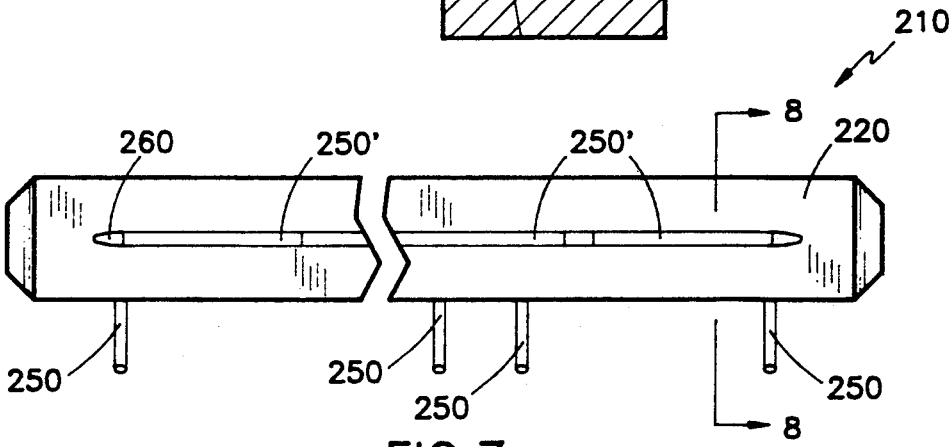
FIG. 7 is a top plan view showing a second alternate embodiment of the invention showing a second holding structure for extra support rods.

Alternately, instead of providing a plurality of auxiliary storage bores 160, it may be seen in FIGS. 7 and 8 that a storage rack 210 can include a base member 220 provided with an elongated groove 260 in its top surface 226. Thus, selected ones of support rods 250 may be placed in an active state, shown in FIG. 8, while extra ones of support rods 250' may be laid longitudinally in groove 260 so as to be stored in a passive state available for future use.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A storage rack adapted to be mounted on an upright support surface and operative to support implements of various sizes and shapes in a stored state, comprising:

(a) an elongated base member of a selected length, said base member having a front surface and a back surface and provided with a plurality of support rod bores each extending from a respective bore opening in said front surface at least partially through said base member and having a bore axis oriented at an acute angle with respect to said front surface;

(b) means for mounting said base member to said support surface; and (c) a plurality of elongated support rods, each said support rod including a first end portion sized and dimensioned for close-fitting yet slideable and releasable mated engagement with each of said support rod bores to define an active state and including a second end portion extending forwardly and upwardly from said front surface when in the active state so as to terminate at a free second end whereby a selected number of said support rods may be inserted in selected ones of said support rod bores wherein said support rods are organized in a changeable array adapted to receive and support said various sizes and shapes of said implements from said base member alongside said support surface.

2. A storage rack according to claim 1 wherein said support rod bores are equidistantly spaced from one another.

3. A storage rack according to claim 1 wherein said base member has a top surface, said free end of each said support rod when in the active state terminating generally in a common plane with said top surface.

4. A storage rack according to claim 1 wherein each of said support rod bores is cylindrical in cross-section and wherein each of said support rods is cylindrical in cross-section.

5. A storage rack according to claim 1 wherein the first end portion of each said support rod terminates in a flat transverse face, each said support rod bore extending only partially through said base member and terminating in a flat transverse end wall opposite its respective bore opening whereby when said support rods are in the active state, each respective flat face is generally flush with a respective flat end wall.

6. A storage rack according to claim 1 wherein said base member has a plurality of mounting bores extending completely therethrough, said mounting means comprising threaded fasteners sized to extend through said base member to fasten to said support surface.

7. A storage rack according to claim 6 wherein each mounting bore has a mounting bore opening in said front surface with said mounting opening being countersunk to define a mounting bore cavity, each said fastener having a head received in the mounting bore cavity and including a plurality of cap elements, there being a cap element for enclosing each of the mouting bore cavities.

8. A storage rack according to claim 1 wherein said mounting means mounts said back surface generally flush with said support surface.

9. A storage rack according to claim 1 wherein said base member is constructed of wood.

10. A storage rack according to claim 1 including holder means formed in said base member for receiving and storing extra ones of said support rods when said extra ones are not in the active state.

11. A storage rack according to claim 11 wherein each said auxiliary storage bore is spaced in between a pair of said support rod bores.

12. A storage rack adapted to be mounted on an upright support surface and operative to support implements in a stored state, comprising:

(a) an elongated base member of a selected length, said base member having a front surface and a back surface and provided with a plurality of support rod bores each circular in cross-section and extending from a respective bore opening in said front surface at least partially through said base member along an axis oriented at an acute angle with respect to the front surface, said bores equidistantly spaced from one another;

(b) means for mounting said base member to said support surface; and (c) a plurality of elongated cylindrical support rods, each said support rod including a first end portion sized for close-fitting yet slideable and releasable mated engagement with each of said support rod bores to define an active state and including a second end portion extending forwardly of and upwardly from said front surface when in the active state so as to terminate at a free second end whereby a selected number of said support rods may be inserted in selected ones of said support rod bores and thus organized in a selected yet variable array to receive and support said implements from said base member alongside said support surface.

13. A storage rack according to claim 14 wherein said base member has a top surface, said free end of each said support rod when in the active state terminating generally in a common plane with said top surface.

14. A storage rack according to claim 14 wherein the first end portion of each said support rod terminates in a flat transverse face, each said support rod bore extending only partially through said base member and terminating in a flat transverse end wall opposite its respective bore opening whereby when said support rods are in the active state, each respective flat face is generally flush with a respective flat end wall.

15. A storage rack according to claim 14 including holder means formed in said base member for receiving and storing extra ones of said support rods when said extra ones are not in the active state.

16. A storage rack adapted to be mounted on an upright support surface and operative to support implements in a stored stated, comprising:

(a) an elongated base member of a selected length, said base member having a front surface, a back surface and a top surface, said base member provided with a plurality of support rod bores each extending from a respective bore opening in said front surface at least partially through said base member;

(b) means for mounting said base member to said support surface;

(c) a plurality of elongated support rods, each said support rod including a first end portion sized and dimensioned for close-fitting yet slideable and releasable mated engagement with each of said support rod bores to define an active state and including a second end portion extending forwardly of said front surface when in the active state so as to terminate at a free second end whereby a selected number of said support rods may be inserted in selected ones of said support rod bores and thus organized in a selected yet variable array to receive and support said implements from said base member alongside said support surface; and (d) holder means for receiving and storing extra ones of said support rods when said extra ones are not in the active state, said holder means formed in the top surface of said base member.

17. A storage rack according to claim 16 wherein said holder means is defined by a plurality of auxilliary storage bores formed in said top surface and each sized to receive an extra one of said support rods.

18. A storage rack according to claim 16 wherein said holder means is defined by an elongated groove formed in said top surface.

* * * * *